United States Patent [19]

Herbert

[11] Patent Number: 4,798,546

[45] Date of Patent: Jan. 17, 1989

[54] BIFURCATED FUSE CLIP

[75] Inventor: William G. Herbert, Ellisville, Mo.

[73] Assignee: Cooper Industries, Inc., Houston, Tex.

[21] Appl. No.: 127,980

[22] Filed: Dec. 3, 1987

[51] Int. Cl.[4] ..... H01H 85/16

[52] U.S. Cl. ..... 439/830; 439/832; 439/833; 337/260; 337/261; 337/270

[58] Field of Search ..... 439/830, 831, 832, 833; 337/261, 265, 268, 270, 260

[56] References Cited

U.S. PATENT DOCUMENTS

| | | | |
|---|---|---|---|
| 1,867,784 | 7/1932 | Trumbull | 337/265 X |
| 2,537,827 | 1/1951 | Heath | 337/261 X |
| 2,738,486 | 3/1956 | Wadsworth | 439/830 X |
| 3,190,987 | 6/1965 | Fister | 337/261 X |
| 3,339,119 | 8/1967 | Stanback et al. | 439/830 X |
| 3,742,414 | 6/1973 | Gittin et al. | 337/265 X |
| 4,084,146 | 4/1978 | Baumann | 439/832 X |
| 4,176,906 | 12/1979 | Urani | 439/830 X |
| 4,278,316 | 7/1981 | White | 439/831 X |
| 4,496,929 | 1/1985 | Urani | 337/265 |
| 4,531,793 | 7/1985 | Hochgesang | 439/830 X |
| 4,606,590 | 8/1986 | Kauffmann et al. | 439/830 X |
| 4,643,510 | 2/1987 | Urani | 439/830 X |
| 4,751,422 | 6/1988 | Morianz et al. | 439/830 X |

FOREIGN PATENT DOCUMENTS

| | | | |
|---|---|---|---|
| 85856 | 9/1965 | France | 439/833 X |

*Primary Examiner*—William L. Sikes
*Assistant Examiner*—Brian M. Healy
*Attorney, Agent, or Firm*—Haight & Hofeldt

[57] ABSTRACT

A novel fuse holder for a fuse as described for a fuse of the type having two generally flat, parallel spaced apart, oppositely disposed electrical contacts. The fuse holder comprises an insulating block and a fuse clip which is formed from a single strip of electrically conducting material and which is carried within the fuse block. The fuse clip features an elongated base member, a pair of spaced apart arms joined to one end of the base member, and a pair of springingly loaded, generally elongated, bifurcated fuse accepting contacts. Each fuse accepting contact is comprised of a flat fuse contacting section and a flat fuse accepting section.

26 Claims, 2 Drawing Sheets

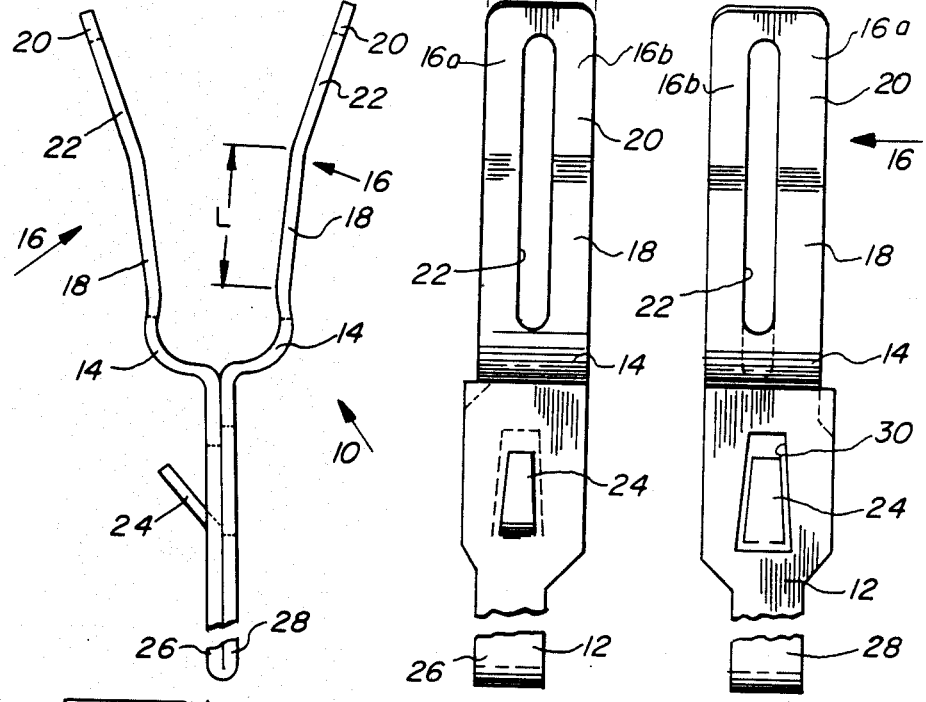
FIG. 1
FIG. 1L
FIG. 1R
GRAIN DIRECTION
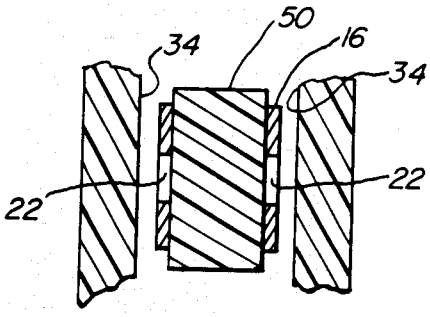
FIG. 4
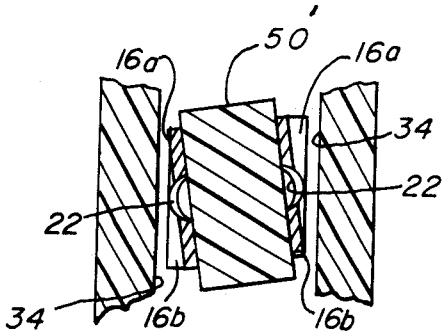
FIG. 4A

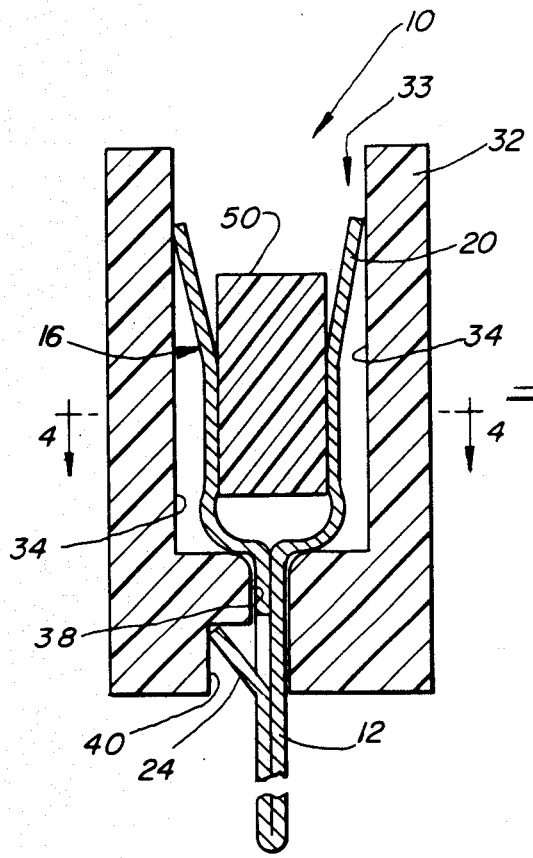
FIG. 2
FIG. 3B
FIG. 3D
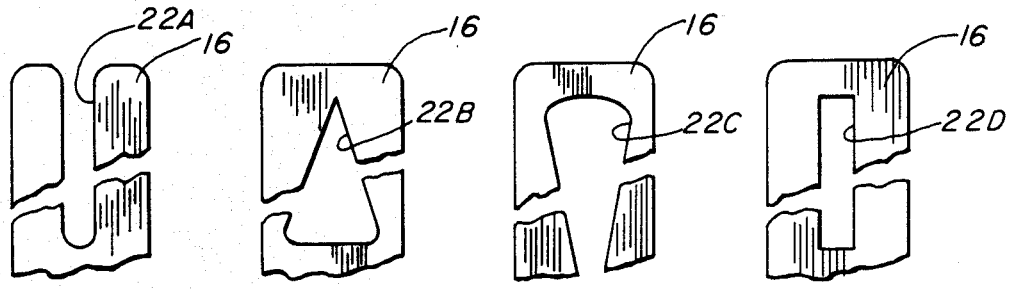
FIG. 3A
FIG. 3C
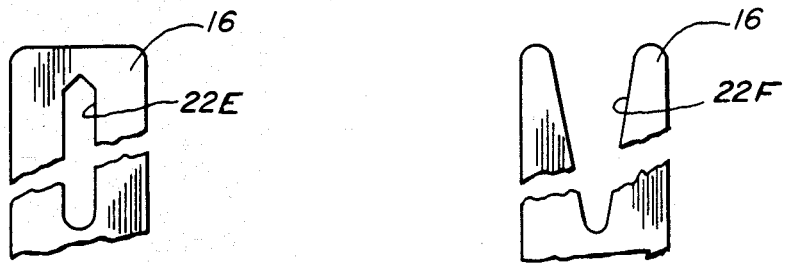
FIG. 3E
FIG. 3F

BIFURCATED FUSE CLIP

TECHNICAL FIELD

This invention relates generally to the subject of fuses and, in particular, to a fuse clip and fuse holder.

BACKGROUND OF THE INVENTION

U.S. Pat. No. 3,190,987 to A. H. Fister, and assigned to the assignee of the present invention, describes what is now commonly referred to as a GMT fuse or a "grasshopper fuse". Another such fuse is disclosed in U.S. Pat. No. 4,496,929, and is also assigned to the assignee of the present invention. These fuses are commonly used in telecommunications, computer or control circuits. One special feature of these fuses is that they provide visual spring indicating and alarm circuit indicating capabilities. Basically, such a fuse incorporates a resilient contact that is normally held out of engagement with an adjacent alarm contact by the fusible element of that fuse and that moves into engagement with the alarm contact when that fusible element "blows". These fuses are manufactured by the Bussmann Division of Cooper Industries in connection with HLT, HLS, HWT, and PCT fuse holders.

These fuses are used in combination with a fuse carrier which is made rugged and strong so that the fuse can be grasped to facilitate its insertion into and its removal from a recess within the fuse holder for that fuse. The fuse carrier has terminals secured thereto which are electrically connected only through the medium of the fuse element of that fuse and only in the event that the fusible element "blows".

The terminals of the fuse carrier are adapted to be received and held by terminals in a fuse holder designed for that fuse. The fuse holder typically has a recess in which part of the fuse carrier can extend with the walls of that recess serving to guide or position the terminals of the fuse holder.

The terminals in the fuse holder are generally U-shaped in elevation and have short confronting faces which are convex. The upper and lower ends of the terminals abut and are held against outward movement by portions of the inner faces of that fuse holder. The overall result is that the confronting faces of the arms of the terminals of the fuse holder are resistant to bending and will thus firmly grip and hold the terminals of the fuse carrier of the fuse. The terminals are held to the fuse holder by means of a shank which extends through an opening in the closed end of the aforesaid recess and are then twisted to prevent separation of those terminals from the fuse holder.

Operating experience has shown that there are some short comings with the design just described. The convex confronting faces of the terminal essentially results in one point contact per side of the fuse clip. In addition, the fuse clip, when assembled in a fuse holder with a fuse installed, was found to be susceptible to a widely changing electric resistance at the fuse clip-contact interface, when subjected to shock or vibration. Part of the reason may be that clip length is relatively short and fuse contact geometry was not always the same. U.S. Pat. No. 4,643,510 to Urani describes one attempt to improve upon the situation by providing a fuse clip with two points of contact on each side of the fuse; it too is a short clip.

There are other problems. High insertion forces are experienced when inserting the fuse into the fuse holder as a result of the fuse clip being relatively short in length and having very little "spring". The insertion force can be lowered by making the clips from a soft material, such as brass. If made from a beryllium-copper alloy, a post-forming, averaging, heat treatment is performed on the fuse clips (i.e., typically done at 800 degrees F. for two hours in the case of a beryllium-copper clip). This heat treatment increases electrical conductivity slightly, but lowers the tensile strength and reduces the mechanical resistance of the clip. In either case, clips were found to take on a "set" when fuses were inserted and extracted many times. Moreover, if the above-described heat treatment was used, it was found that this time and temperature combination was not easy to control, unless it was watched very closely. Thus, there is a need for an improved fuse clip which does not have these short comings.

SUMMARY OF THE INVENTION

In accordance with the present invention, a fuse clip is disclosed which: is formed from a single strip of beryllium-copper material which can be heat treated after forming; is adapted to be easily mounted in a fuse accepting recess of an insulated fuse holder; and is provided with two spaced apart, springingly loaded, generally elongated, confronting, bifurcated fuse accepting contacts which are joined to each other at one end and which have their free ends flaring upwardly and outwardly from each other.

In one specific embodiment, each fuse accepting contact has a substantially flat fuse contacting section which is generally equal in length and the width to the flat electrical contacts of the fuse or fuse carrier, and has a generally flat fuse accepting section which has one end that is joined to the fuse contacting section and which has an opposite end that is adapted to be disposed adjacent to the walls of the fuse block cavity or recess. Preferably, the length of the fuse accepting section is sufficiently long that when the fuse clip is inserted into the block of a fuse holder, the fuse contacting sections will be disposed generally parallel to each other.

From the foregoing, it should be clear that there are substantial advantages to the present invention. The long flat contacting surface provided by the bifurcated fuse accepting contacts results in at least two-point contact on both sides of the clip and better electrical contact. The elongated fuse accepting contacts provide a more gradual lead-in angle and improved springiness. The result is that insertion and removal forces are lowered without comprising the reliability of the fuse. Moreover, a heat treatment of 600 degrees F for as little as two hours has been found to be acceptable. Such a fuse clip has been found to be able to withstand repeated insertion and extraction cycles, and the heat treatment process has been found to be easier to control. Finally, by virtue of the long, flexible, bifurcated structure of the fuse clips and the improved electrical and mechanical contact between the fuse and the fuse clip, the fuse/-fuseclip interface is less susceptible to changes in electrical resistance when subjected to shock or vibration.

Many other advantages and features of the invention will become readily apparent from the following detailed description of the invention, and the embodiments there described, and from the claims and from the accompanying drawings.

BRIEF DESCRIPTION OF THE DRAWINGS

FIGS. 1, 1L and 1R are front, left side and right side elevational views, respectively, of the fuse clip that is the subject of the present invention;

FIG. 2 is a partial cross-sectional elevational view of the fuse clip of FIG. 1 installed in a fuse block;

FIGS. 3A through 3E are partial side views of the fuse clip of FIG. 1 showing variations in the opening provided therein at the upper end of the fuse clip; and FIGS. 4 and 4A are cross-sectional plan views of the fuse clip of FIG. 2, as viewed along line 4—4.

DETAILED DESCRIPTION

While this invention is susceptible of an embodiment of many different forms, there is shown in the drawings, and will herein be described in detail, several preferred embodiments of the invention. It should be understood, however, that the present disclosure is to be considered as exemplifications of the principles of the invention and that it is not intended to limit the invention to the specific embodiment illustrated.

Turning now to FIG. 1, there is shown an elevational view of the fuse clip 10 that is the subject of the present invention. The fuse clip 10 comprises: an elongated base member or shank 12; a pair of oppositely disposed, upwardly and outwardly extending base arms 14 at the upper end (according to the orientation of FIG. 1) of the shank; and a pair of generally elongated fuse accepting contacts 16 which are connected to the base arms.

Each fuse accepting contact 16 comprises a flat fuse contacting section 18 and a flat fuse accepting section 20. Preferably, both sections 18 and 20 are substantially flat. Each fuse accepting contact 16 also has a central elongated aperture or opening 22. As shown in FIGS. 1L and 1R, the aperture 22 is generally elongated and is defined by two generally parallel vertical edges and two semi-circular edges which join together the two vertical edges. As shown in the drawings, the width of the aperture 22 is approximately one-third the total width "W" of the fuse accepting contact 16. One prototype design was made from 0.012 thickness beryllium-copper (at ¼ hardness) which was subsequently tin plated to a thickness of approximately 0.0003 inches. In that design, the aperture 22 has a width of approximately 0.022 (nominal) inches and the fuse accepting contacts have a total width "W" of approximately 0.094 inches. The over all length of the fuse accepting contacts is approximately 0.325 inches.

Turning now to the shank 12, disposed intermediate the ends of the shank is a locking tab 24. The locking tab 24 is a generally three-sided element which has been separated from at least one of the two members 26 and 28 which form the shank. In the case of embodiment shown in FIG. 1, an aperture or clearance hole 30 is provided in the right-hand member 28 which is used during the manufacturing process to punch the locking tab 24 from the left-hand member 26. Because of this particular fabrication process, it will be observed that the marginal portions of the upper end of the shank have been extended so that the upper end of the shank is wider than that of the lower end. The aperture 22 in each fuse accepting contact 16 may extend around the base arms 14, almost down to the clearance hole 30 for the locking tab 24.

Turning now to FIG. 2, there is shown a partial cross-sectional elevational view of a fuse block 32 with the fuse clip 10 of FIG. 1 inserted. The fuse block 32 is formed from an insulating material and is provided with a fuse accepting aperture or cavity 33 which is defined by two generally vertical walls 34 and a bottom wall 36 that is disposed between the two vertical walls. The bottom wall 36 is provided with a fuse clip accepting aperture 38 and an adjacent cavity 40 for accepting locking tab 24 of the fuse clip. The fuse clip accepting aperture 38 has approximately the same cross-section as that of the shank 12 of the fuse clip 10 so as to provide a snug fit. Of course, when the fuse clip 10 is inserted into the fuse clip accepting aperture 38 in the fuse block 32, the locking tab 24 will be bent inwardly and then spring outwardly once it enters the locking tab cavity 40. If the locking tab 24 and corresponding cavity 40 are not used, the shank 12 of the fuse clip can be twisted at its free end (i.e., the lower end according to the orientation of FIG. 2) in order to hold fuse clip within the fuse block.

Turning again to FIG. 1, it will be noted that the base arms 14 are generally arcuate in shape with their centers disposed between the two fuse accepting contacts 16. Each fuse contacting section 18 has its lower end connected to the upper end of its base arm 14 and has its upper end connected to the lower end of the fuse accepting section 20. Prior to being inserted in the fuse block (see FIG. 2), the fuse contacting section, in this particular embodiment, extends approximately 6 degrees from the vertical and the fuse accepting section 20 extends an additional 12½ degrees, for a total of 18½ degrees, from the vertical. The length of the fuse accepting section 20 selected such that when the fuse clip 10 is inserted into its fuse block 32 (See FIG. 2), the two fuse accepting contacts 16 will be compressed springingly inwardly towards each other so that the fuse contacting sections 18 are parallel to each other and the centerline of the cavity provided in the fuse block.

Since grasshopper fuses are generally provided with two flat, parallel, spaced-apart, oppositely disposed, electrical contacts, such a fuse 50 will snugly fit within the space between the two fuse contacting sections 18 of the fuse clip 10. Preferably, the fuse contacting section 18 is substantially flat and has a length "L" (See FIG. 1) approximately equal to the length of the corresponding contacts on the fuse or fuse carrier.

Turning now to FIG. 4, ideally, the fuse 50 is inserted into the fuse block 32 in such a manner that its oppositely disposed fuse terminals are generally parallel to the vertical walls 34 of the fuse cavity. Due to manufacturing tolerances, there are variations in the manner in which such fuses 50 fall within the confines of the fuse block 32. FIG. 4A shows an exaggerated arrangement wherein the fuse 50' does not fit perfectly parallel within the fuse accepting aperture or cavity 33. However, by virtue of the large elongated aperture 22 provided within the fuse accepting contacts 16 of the fuse clip 10, the two faces 16*a* and 16*b* are somewhat free to twist to accommodate this geometry. This would not all be possible with a short stubby fuse contact, particularly one as that illustrated in FIG. 11 of U.S. Pat. No. 3,190,987. Thus, the fuse clip 10, by virtue of its longer spring members and flexible bifurcated flat contact design, forms its self to different geometries of the fuse contact surfaces, thereby forming a flexible mating connection that resists changes in electrical resistance when the fuse is subjected to shock or vibration. Moreover, an essentially flat two-point contact on each side of the fuse clip is provided, instead of a simple one-point contact arrangement of U.S. Pat. No. 3,190,987 or the relatively small contacting surfaces of U.S. Pat. No. 4,643,510. Thus, better electrical connection between the fuse and the fuse clip is provided. In addition, by forming the fuse accepting contacts 16 to have a relatively long length compared to that portion which is in contact with the fuse, a more gradual lead-in angle is provided. Heretofore, fuse insertion forces exceeded 15 pounds at times. Even when a sizing tool was used, the insertion forces ranged between 5 and 8 pounds; however, when a sizing tool is used, the manufacturing cost increases. Thus, under the prior design, insertion forces between 8 and 15 pounds (12 pounds nominal) were experienced when using fuse contacting terminals whose two fuse contacting sections combined to have a cross-sectional area of approximately 0.00230 sq. in. The present invention has a cross-sectional area of approximately 0.00173 sq. in. which is only a 75% of the prior design while the insertion force is between 2½ and 5 pounds (3½ pounds nominal). In other words, the fuse insertion force has been reduced by approximately 70% while only reducing the cross-sectional area by approximately 25%. This result would not at all be expected by simply changing the shape and contour of the fuse clip.

The fuse clip is preferably made from a single strip of beryllium-copper 172 (available from Brush-Wellman Inc. of Cleveland, Ohio under the tradename Brush Alloy 25) that has been heat treated at approximately 600 to 625 degrees F. for approximately 2 to 4 hours after forming. Maintaining a heat treatment of approximately 600 to 625 degrees F. for two hours is much easier to control than a heat treatment at 800 degrees F. for two hours or more. The lower temperature heat treatment also improves the resistance of the clip against taking on a "set" when the fuse is inserted and extracted many times.

From the foregoing, it will be observed and numerous variations and modifications may be effected with departing from the true scope and spirit of the novel concept of the invention. For example, FIGS. 3A through 3F illustrate other arrangement that may be used to provide a bifurcated structure to the fuse accepting contacts 16. As another example, broken lines at the upper left-hand corner of FIG. 1L and the upper righthand corner of FIG. 1R are used to illustrate that the upper part of the shank 12 may be cutoff to eliminate a sharp edge. Thus, it should be understood that no limitation with respect to specific structure illustrated and described is intended or should be inferred. It is, of course, intended to cover by the appended claims all such modifications as fall within the scope of the claims.

I claim:

1. A fuse holder for a fuse of the type having two generally flat, parallel, spaced-apart, oppositely disposed, electrical contacts, comprising:

(a) an insulated block having a fuse accepting aperture defined by two generally vertical walls and a bottom wall disposed between said two vertical walls, said bottom wall having a fuse clip accepting aperture therein; and (b) a fuse clip which is formed from a single strip of electrically conducting material and which is carried by said fuse clip accepting aperture in said insulated block, said fuse clip having:

(i) an elongated base member which fits within said fuse clip accepting aperture in said bottom wall and which has two opposite ends;

(ii) a pair of spaced apart base arms joined to one end of said base member, said base arms being adapted to fit within said fuse accepting aperture adjacent said bottom wall, each base arm extending upwardly and outwardly from said one end of said base member; and (iii) a pair of springingly loaded generally elongated fuse accepting contacts, each contact having one end joined to one of said base arms and having the opposite end flaring upwardly and outwardly toward the top of said vertical walls when said fuse clip is inserted in said insulated block, said fuse accepting contacts having a flat fuse contacting section which is located adjacent said base arms and which is generally equal in length to the flat electrical contacts of the fuse, and having a fuse accepting section which has one end joined at an angle to said fuse contacting section and which has an opposite end which is adapted to be disposed adjacent the top of said vertical walls when said fuse clip is inserted in said insulated block, the length of said fuse accepting section and said angle being such that when said fuse clip is inserted into said block, said fuse contacting sections are disposed generally parallel to each other.

2. The fuse holder of claim 1, wherein each of said fuse accepting contacts is generally flat and has a generally elongated aperture located therein, the length of said aperture being generally equal to the length of said fuse accepting contacts.

3. The fuse holder of claim 2, wherein said aperture is defined by two generally straight edges which extend along the length of said fuse accepting contacts and is defined by at least one semi-circular edge which joins said straight edges.

4. The fuse holder of claim 3, wherein said straight edges are parallel to each other and are joined together by two semi-circular edges.

5. The fuse holder of claim 1, wherein the length of said fuse accepting section is generally the same as said fuse contacting section.

6. The fuse holder of claim 1, wherein said base member includes a locking tab which is located intermediate said ends of said base member and which is adapted to move between an inward position when said base member is forcibly inserted from said fuse accepting aperture and into said fuse clip accepting aperture and between an outward position when thereafter said tab abuts the opposite end of said fuse clip accepting aperture.

7. The fuse holder of claim 1, wherein said fuse clips are made from beryllium-copper, and wherein said fuse clips have been heat treated to a temperature at least between 500 degrees F. and 700 degrees F. for between two and four hours.

8. The fuse holder of claim 6, wherein said bottom wall has one surface disposed between said two vertical walls and has an opposite surface, said fuse clip accepting aperture being located between said one surface and said opposite surface; and wherein said opposite surface has a cavity therein which is adjacent to an opening to said fuse clip accepting aperture so as to accept said locking tab when it is in its outward position.

9. The fuse holder of claim 6, wherein said locking tab has one end joined to said base member and a free end which is springingly disposed outwardly and generally in the direction of said opposite end of said fuse accepting section of one of said fuse accepting contacts.

10. The fuse holder of claim 6, wherein said tab is generally trapezoidal in shape.

11. The fuse holder of claim 1, wherein said base member is formed from two generally rectangular members which are joined together at one end and which have their opposite ends joined to said base arms.

12. The fuse holder of claim 11, wherein said base arms are generally arcuate in shape with their centers disposed between said fuse accepting contacts.

13. The fuse holder of claim 2, wherein said aperture has a width generally between one-fourth and one-third the width of the fuse accepting contact in which it is located.

14. In a holder for a grasshopper fuse, the holder being formed from a block having a generally rectangular fuse accepting cavity formed therein, the fuse accepting cavity being defined by two opposite walls and bottom wall with the bottom wall having a fuse clip accepting aperture therein, a fuse clip comprising:

(a) a generally elongated shank which is adopted to snugly fit within the fuse clip accepting aperture in the block, said shank being formed from two elongated generally flat rectangular members which are joined at one end and which have their opposite ends extending outwardly from each other to form a pair U-shaped arms which are adapted to fit within the cavity in the block; and (b) a pair of springy, elongated, oppositely disposed, fuse accepting contacts, each of which is joined to one of said arms and flares upwardly and outwardly away from each other towards the top of the two opposite walls of the cavity when said fuse clip is inserted into the block, each fuse accepting contact having at one end a bifurcated fuse contacting section which is located adjacent said arms and which is generally equal in length to the contacts of the fuse, each fuse accepting contact having at its opposite end a fuse accepting section which has one end joined to said fuse contacting section and which has an opposite free end, said fuse accepting section having generally the same length as said fuse contacting section, said fuse accepting section having a length and flare such that when said fuse clip is inserted into the block each fuse contacting section is disposed generally parallel to each other at a spaced apart distance approximately equal to that of the corresponding electrical contacts of the fuse and is disposed springingly relative to the two opposite walls of the fuse cavity.

15. The fuse clip of claim 14, wherein each fuse accepting contact has a generally elongated opening located therein which is generally equal in length to the length of said fuse accepting contacts, whereby said fuse contacting section and said fuse accepting section are both bifurcated.

16. The fuse clip of claim 15, wherein said opening is defined, in part, by two parallel straight edges; and wherein said opening extends into said U-shaped arms.

17. A fuse clip which is formed from a single strip of electrically conductive material which is adapted to be springingly mounted within a fuse accepting aperture in an insulated fuse block, the fuse clip being characterized by two spaced apart, generally elongated, confronting, bifurcated fuse accepting contacts joined to each other at one end and having their free ends flaring upwardly and outwardly from each other, each fuse accepting contact having:

(a) a substantially flat fuse contacting section which is generally equal in length and width to the flat electrical contacts of the fuse; and (b) a generally flat fuse accepting section which has one end that is joined at an angle to said fuse contacting section and which has an opposite end that is adapted to be disposed adjacent the walls of the fuse accepting aperture, said fuse accepting section having a length such that when said fuse clip is inserted into the block of a fuse holder, said fuse contacting sections are disposed generally parallel to each other.

18. The fuse clip of claim 17, wherein the fuse holder has an opening therein at the bottom of the fuse accepting aperture; and wherein said fuse accepting contacts are joined to each other by a flat elongated shank which is adapted to snugly fit within said opening in the fuse holder.

19. The fuse clip of claim 18, wherein said shank has a width less than that of said fuse accepting contacts.

20. The fuse clip of claim 17, wherein said fuse accepting section is inclined approximately 18 degrees from a reference line which bisects said fuse clip and said fuse contacting section is inclined approximately 6 degrees from said reference line before said fuse contacts are inserted into the fuse holder.

21. The fuse clip of claim 17, wherein each fuse contact has an elongated aperture therein which has a width approximately one-fourth the width of fuse contact.

22. The fuse clip of claim 17, wherein said aperture in said fuse contact has two opposite ends which define the length of said aperture; and wherein the margins of said fuse contact adjacent that opposite end which is adjacent said free end of said fuse contact is less than that of the margins adjacent the shorter dimension of said aperture at said free end.

23. The fuse clip of claim 18, wherein the opening in said fuse holder is generally rectangular, and wherein said shank has a lower end which is adapted to fit within said rectangular opening and an upper end which is wider than said lower end and which is adapted to fit within said bottom of said fuse accepting aperture.

24. The fuse clip of claim 23, wherein said upper end is wider than said fuse accepting contact to which it is joined.

25. The fuse clip of claim 24, wherein said upper end of said shank includes a locking tab.

26. The fuse clip of claim 17, wherein said electrically conductive material is a beryllium-copper alloy; and wherein after said clip is formed it is heat treated at approximately 600 to 625 degrees F. for no more than 3 hours.

* * * * *